United States Patent [19]

Hillebrand

[11] Patent Number: 4,584,976

[45] Date of Patent: Apr. 29, 1986

[54] RESERVOIR HEIGHT EXTENDER FOR LASH ADJUSTER ASSEMBLY

[75] Inventor: George A. Hillebrand, Battle Creek, Mich.

[73] Assignee: Eaton Corporation, Cleveland, Ohio

[21] Appl. No.: 746,708

[22] Filed: Jun. 20, 1985

[51] Int. Cl.[4] ..... F01L 1/24

[52] U.S. Cl. ..... 123/90.55; 123/90.46; 123/90.5; 123/90.27

[58] Field of Search ..... 123/90.46, 90.55, 90.56, 123/90.57, 90.58, 90.5, 90.27

[56] References Cited

U.S. PATENT DOCUMENTS

| | | | |
|---|---|---|---|
| 4,361,120 | 11/1982 | Kueny | 123/90.55 |
| 4,367,701 | 1/1983 | Buente | 123/90.55 |
| 4,373,477 | 2/1983 | Buente et al. | 123/90.55 |
| 4,392,462 | 7/1983 | Lesher | 123/90.55 |
| 4,397,271 | 8/1983 | Gardner | 123/90.55 |
| 4,437,439 | 3/1984 | Speil | 123/90.55 |
| 4,465,038 | 8/1984 | Speil | 123/90.55 |
| 4,470,381 | 9/1984 | Buente et al. | 123/90.55 |

*Primary Examiner*—Ira S. Lazarus

*Attorney, Agent, or Firm*—C. H. Grace; A. E. Chrow; R. A. Johnston

[57] ABSTRACT

A reservoir height extender for a lash adjuster assembly (150) comprising an inverted hollow insert member (60) disposed in fluid reservoir chamber (42) within a plunger member (40) of assembly (150). Plunger member (40) is reciprocally moveable within a bore (38) of a body member (36) having a first fluid passageway (48) adapted to receive fluid from a fluid source and which communicates with a second fluid passageway (46) in plunger member (40) adapted to enable the fluid to flow into fluid reservoir chamber (42). Insert member (60) is displaced from a wall of plunger member (40) surrounding chamber (42) for a distance sufficient to provide a third fluid passageway (68) therebetween which communicates between passageway (46) and an opening (64) through insert member (60) that is higher than passageway (46) and which enables a substantial increase in the level of fluid within reservoir chamber (42).

8 Claims, 5 Drawing Figures

RESERVOIR HEIGHT EXTENDER FOR LASH ADJUSTER ASSEMBLY

INTRODUCTION

This invention relates generally to a fluid operated lash adjuster assembly operative to prevent back-lash in the drive train of a valve member of an internal combustion engine by means of a resevoir of fluid contained within the assembly and more particularly to an improved lash adjuster assembly provided by including means for raising the surface of the fluid resevoir to increase its capacity and thereby enhance operation of the assembly particularly after an extended period of engine shut-down.

BACKGROUND OF THE INVENTION

Lash adjuster assemblies have been employed for many years for reducing noise and back-lash associated with the operation of combustion engine cylinder valve members. Such assemblies generally provide a cyclically pressurized fluid interface at some point in the linking mechanism (drive train) operating the valve members to provide smoother operation and to reduce noise and back-lash as they operate cyclically in conjunction with the valve piston members.

Generally, the term "lash adjuster" as used herein denotes two different types of which one features a plunger member moveable in response to cyclical pressurization of fluid for operation of the valve member by reciprocal movement of a body member of the assembly reciprocated by rotation of a cam member driven by the engine and the other, commonly called "tappet assembly", wherein the body member is held in a relatively stationary condition and the cam member drives the plunger member cyclically rather than the body member.

Both types generally feature an internal chamber within the plunger member for providing a resevoir of fluid of which a portion is cyclically pressurized by the reciprocal movement of the plunger member with the resevoir being in fluid communication with a source of fluid commonly located in the engine block outside of the body member by means of fluid passageways through respective walls of the plunger member and the body member.

Fluid operated lash adjuster assemblies of interest to the present invention are of the type wherein the capacity of the resevoir within the plunger member is limited by the height of the fluid passageway by which fluid is able to enter the plunger member chamber containing the resevoir of fluid.

Although some lash adjusters feature a fluid passageway into the plunger member resevoir chamber that is adjacent the upper-most height of the chamber such as disclosed in U.S. Pat. Nos. 2,737,934; 2,815,740; 4,361,120 and U.S. Reissue Pat. No. 24,506, the disclosures of which are incorporated herein by reference, others, such as disclosed in U.S. Pat. No. 3,025,842, the disclosure of which is incorporated herein by reference, do not, but rather feature a fluid passageway entrance into the plunger member chamber that is substantially lower than the actual vertical height of the chamber which limits the resevoir capacity within the chamber.

It is to the latter type of lash adjuster assemblies to which the present invention is addressed, i.e. those lash adjusters assemblies for which the height of the fluid resevoir within the plunger member chamber is less than the height of the chamber by reason of the location of the fluid passageway entry location into the chamber which necessarily limits the resevoir capacity which, in turn, may lead to insufficient fluid source for proper operation particularly on start-up after the engine has been idle for extended periods of time.

SUMMARY OF THE INVENTION

Accordingly, it is an object of this present invention to provide an improved fluid operated lash adjuster assembly for preventing back lash in the drive train of an internal combustion engine valve member.

It is another object of this present invention to provide an improved fluid operated lash adjuster assembly for operation of a valve member of an internal combustion engine that is provided with means for increasing the fluid resevoir capacity utilized thereby to enhance the operation thereof particularly on start-up after an extended period of engine shut down.

DESCRIPTION OF SOME PREFERRED EMBODIMENTS

Figure 1:
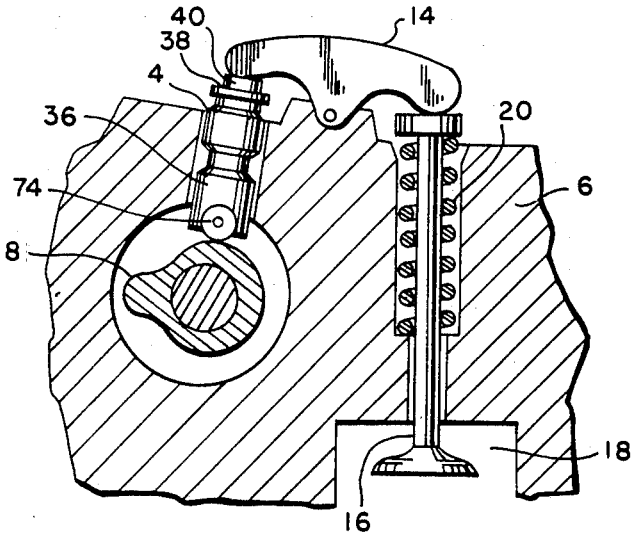
FIG. 1 shows a partial side elevation cross-sectional view of an application in which a body member of the lash adjuster assembly of the invention is held reciprocally within an open ended bore of an engine block.
Figure 3:
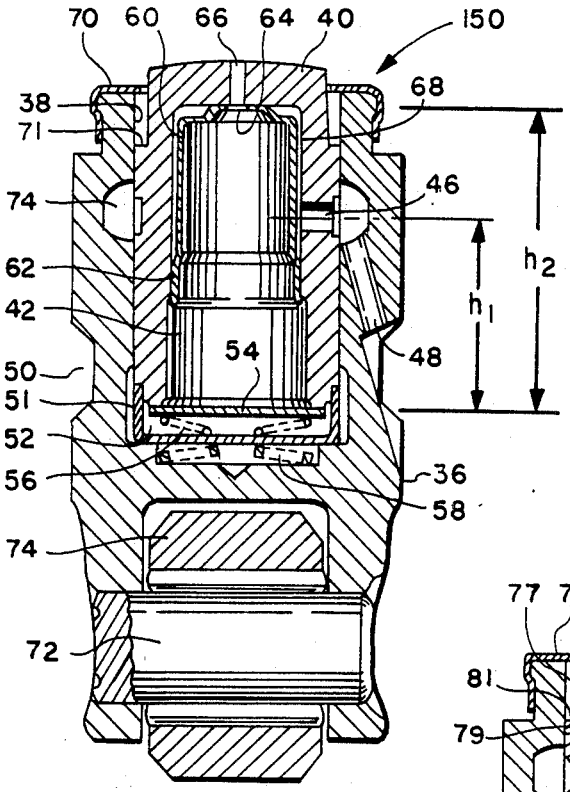
FIG. 3 shows a central side elevation cross-sectional view through an embodiment of the improved lash adjuster assembly of the invention.
Figure 4:
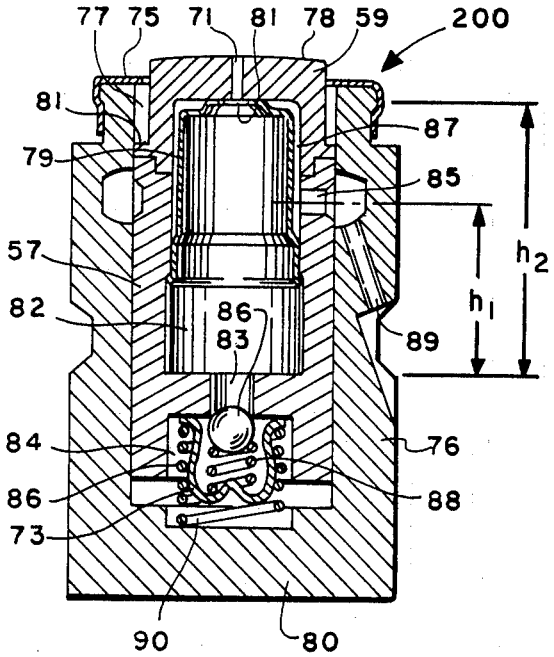
FIG. 4 shows a central side elevation cross-sectional view of another embodiment of the improved lash adjuster assembly of the invention.

FIG. 1 shows an application in which a body member 36 of improved lash adjuster assembly 150 of the invention, more fully described hereinafter with respect to FIG. 4, is mounted reciprocally in a generally inclined position within an open-ended bore 4 of an engine block 6 for operating a valve member 16 of an internal combustion engine cylinder 18. Body member 36 is provided with a bore 38 for receiving plunger member 40 into the open end thereof. Body member 36 has a closed end in biased engagement with rotary cam member 8 driven by the engine. Roller means such as roller 74 may be included at the closed end of body member 36 to provide rolling contact with cam member 8. Rotation of cam member 8 causes body member 36 to reciprocate within bore 4 in synchronous cyclic relationship with cam member 8. Plunger member 40, hereinafter more fully described with respect to FIG. 3, is held in biased engagement to one end of a pivotably mounted rocker arm 14. Rocker arm 14 has its opposite end held in biased engagement with valve member 16 by means of coiled spring 20 as shown in FIG. 1. In FIG. 1, cam member 8 and rocker arm 14 comprise the drive train for valve member 16. Plunger member 40 contains a fluid resevoir and means for cyclically pressurizing the fluid in response to the reciprocating movement of body member 36 providing a pressurized fluid interface between body member 36 and rocker arm 14 for effective operation of valve member 16 while reducing noise and back-lash as well as other advantages well known to those skilled in the art. The fluid operated reciprocating action of plunger member 40 causes rocker arm 14 to rock back and forth and accordingly causes valve member 16 to move in reciprocal synchronous relationship with cam member 8 which itself is synchronized to comport with the combustion cycle within cylinder 18 while at the same time preventing back-lash in the drive train.

Figure 2:
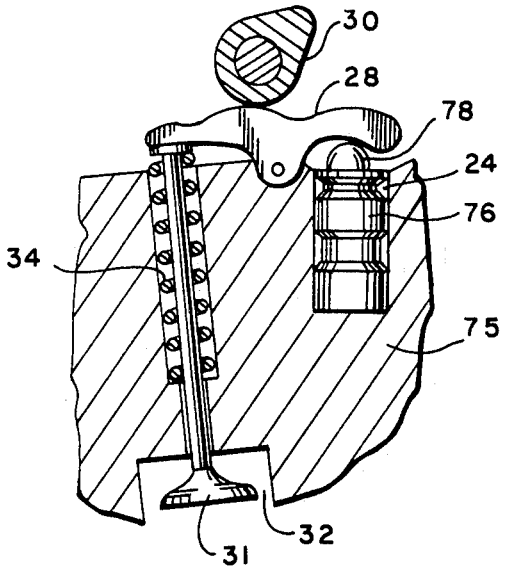
FIG. 2 shows a partial side elevation cross-sectional view of an application in which a body member of the improved lash adjuster assembly of the invention is held fixedly within a closed bottom bore in an engine block.

FIG. 2 shows an application in which body member 76 of an embodiment of the improved lash adjuster assembly of the invention is disposed in a substantially vertical position in a closed bottom bore 24 of block 75 of an internal combustion engine for operation of valve member 31 of cylinder 32 of the engine. In this case a cam member 30 driven by the engine engages pivotablly mounted rocker arm 28 having one end held in biased engagement with valve member 31 by means of coiled spring 34 and an opposite end held in biased engagement with fluid operated plunger member 78 contained in body member 76 of the improved lash adjuster assembly of the invention more fully described hereinafter with respect to FIG. 4.

A portion of a resevoir of fluid contained within plunger member 78 is cyclically pressurized in response to the rocking motion of rocker arm 28 in synchronous relationship to rotation of cam member 30 causing plunger member 78 to move reciprocally to provide fluid cushioned force operative to prevent back-lash in the drive train.

The example applications in FIGS. 1 and 2 are for illustrative purposes only for the improved lash adjuster assembly of the invention may be used for reducing noise and preventing back-lash in a variety of operative drive train connecting arrangements between the assembly and the valve member. Although the improved assembly of the invention can be used to advantage where it is mounted substantially vertically or with a moderate incline, it may also be used horizontally where such is required by the engine design.

FIG. 3 shows an embodiment 150 of the improved fluid operated lash adjuster assembly of the invention. Assembly 150 has a body member 36 that may be either reciprocally or fixedly mounted to an engine block as previously described. The outer surface of body member 36 is preferably cylindrical with an annular outer groove 50 for receiving fluid, commonly oil, from a fluid source for the engine block (not shown).

Body member 36 has an open end and a closed end provided by bore 38 in one end thereof into which is moveably disposed plunger member 40 with one end exposed.

Plunger member 40 is provided with an internal chamber 42 therewithin for containing a resevoir of fluid for operation of assembly 150. The exposed end of plunger member 40 is generally closed excepting for vent opening 66 communicating with chamber 42. Plunger member 40 has an opposite open end thereof communicating with pressurization chamber 52 defined between the lower open end of chamber 42 and the closed bottom end of body member 36 and is separated therefrom by one-way valve means which, in the case of assembly 150, is provided by plate member 54, which is biased against the peripheral wall of plunger member 40 surrounding the generally lower open end thereof between chambers 42 and 52 by suitable resilient biasing means such as spring 56 disposed between plunger member 40 and a bracket 51 supported by the closed end of body member 36 to provide a cyclic fluid seal between the resevoir in plunger member 40 and pressurization chamber 52 operated by reciprocal motion of body member 36, where body member 36 is reciprocally mounted, or by reciprocal movement of plunger member 40 when plunger member 40 is engaged with the engine cam member and body member 36 is disposed in closed bottom bore of the engine block.

Plunger member 40 is also preferably biased away from the closed end of body member 36 by suitable resilient biasing means such as spring 58 which, in the case of assembly 150, biases bracket 51, plate 54 and plunger member 40 away from the bottom of bore 38 in body member 36.

The closed end of body member 36 may include a roller 74 mounted for rotation on pin 72 which is secured to the closed end of body member 36 where such is desired.

The external surface of body member 36 is preferably provided with external circumferential annular groove 50 for receiving fluid, such as engine oil, from a source of fluid and providing same to first fluid passageway 48 which in turn enables fluid to flow from the fluid source into bore 38 of body member 36 and thence by way of second fluid passageway 46 through the side wall of plunger member 40 and into chamber 42 of plunger member 40 to provide a resevoir of the fluid therewithin. An internal circumferential annular groove 74 may be included on the inner surface of bore 38 to enhance fluid communication between the first and second fluid passageways.

The operation of assembly 150 is such that, as viewed in FIG. 3, downward movement of body member 36 relaxes the biased engagement between plate member 54 the peripheral bottom edge of plunger member 40 sufficiently to enable fluid to flow from the resevoir of fluid in chamber 42 into pressurization chamber 52. Upward movement of body member 36 compresses and pressurizes the fluid in pressurization chamber 52 while causing plate 54 to seal the resevoir therefrom. The fluid pressure in chamber 52 causes plunger member 40 to move upwardly away from the bottom of bore 38 of body member 36 to provide a pressurized fluid interface in the drive train of the valve member to which assembly 150 is operatively connected. Vent 66 in the upper generally closed end of plunger member 40 provides a vent from which excess fluid can flow from the resevoir in chamber 42 during the pressurization cycle. Reciprocal movement of body member 36 caused by a rotating cam member driven by the engine then causes cyclic pressurization and depressurization in pressurization chamber 52 that is synchronized with the rotation of the cam member.

Upward movement of plunger member 40 is preferably limited by means of a retainer 70 secured to the open end of body member 36 with a central opening (not referenced) therethrough enabling plunger member 40 to undergo the reciprocal movement described. Plunger member 40 is preferably provided with an annular shoulder 71 adapted to engage retainer 70 and limit movement of plunger member 40 away from the closed end of body member 36 to within a prescribed distance. Retainer 70 is also useful in holding plunger member 40 within bore 38 of body member 36 during handling and shipping and the like and when, for one reason or another, the valve member drive train separates from plunger member 40.

The height "$h_1$" of fluid in the resevoir in chamber 42 was heretofor limited by the height of second fluid passageway 46 through the side wall of plunger member 40. It can readily be seen that, as such, the resevoir of fluid within chamber 42 was considerably less than the potential capacity of chamber 42.

The means by which the fluid resevoir is increased to substantially fill chamber 42 is provided by insert member 60. Insert member 60 is an inverted hollow insert preferably having a generally cylindrical configuration having an open end facing towards the closed end of body member 36 and having a generally closed end except for at least one fluid entrance opening 64 therethrough facing way from the closed end of body member 36.

Insert member 60 is adapted such that outer periphery 62 adjacent its open end can be secured in fluid tight sealing engagement with the inner surface of chamber 42 below the location of second fluid passageway 46 such as by brazing or welding the like where insert 60 is made from a suitable metallic brazable or weldable material. The generally closed end of insert 60 is above the location of passageway 46 and preferaby at the highest height possible within chamber 42 without interfering with vent 66 and yet enable fluid to flow into the resevoir through entrance opening 64 of insert 60. The sides of insert member 60 are spaced apart from the inner surface of the wall of plunger member 40 by a distance sufficient to provide a third fluid passageway 68 communciating opening 64 with second fluid passageway 46 so that fluid can flow from the fluid source through first passageway 48 and thence through second fluid passageway 46 and thence through third fluid passageway 68 and thence through opening 64 into the resevoir.

It can immediately be seen that insert 60 has enabled the height of the fluid resevoir in chamber 42 to increase to height "$h_2$" and thus substantially increase the capacity thereof from which to operate assembly 150 particularly after an extended period of engine shut down which may have caused the assembly to dry out or otherwise have an insufficient amount of fluid in the resevoir on start up to enable assembly 150 to operate in an effective manner.

Preferably, second fluid passageway 46 is located so that, upon reciprocal movement of plunger member 40, it communicates cyclically with first fluid passageway 48 by reason of traveling upwardly a distance which momentarily shuts off fluid communication between first fluid passageway 48 and second fluid passageway 46.

Although insert member 60 may be made of any material suitable to perform in the manner desired as well as being compatible with the fluid involved (which in most cases is the lubricating oil and by the engine) it has been found that insert 60 can be advantageously made from a 1010 type steel having a wall thickness of about 0.010 inch.

FIG. 4 shows an improved lash adjuster assembly 200 made in accordance withe the invention which features a body member 76 having a closed end 80 and a bore 77 providing an opposite open end into which plunger member 78 is moveably disposed.

As viewed in FIG. 4, upward movement of plunger member 78 away from closed end 80 of body member 76 is limited to a prescribed distance by coaction between retainer 75 secured to the open end of body member 76 and annular shoulder 81 of plunger member 78.

Body member 76 is adapted to be either disposed within a closed bottom bore of an engine block as for example shown in FIG. 2 or mounted for reciprocal movement as for example shown in FIG. 1 with the cam member designed to engage closed end 80 of body member 76 in the manner desired. Body member 76 has a first fluid passageway 89 through a side wall providing fluid communication between a source of fluid (not shown) and bore 77. Plunger member 78 has a generally closed upper end save for at least one vent opening 71 therethrough communicating with a chamber 82 therewithin for containing a resevoir of fluid for operation of assembly 200. The opposite end of plunger member 78 facing towards the closed end 80 of body member 76 has a pressurization chamber 84 communicating with chamber 82 by means of opening 83. As viewed in FIG. 4, pressurization chamber 84 includes a portion of bore 77 adjacent the closed end of body member 76.

Chamber 82 is cyclically sealed from pressurization chamber 84 by one-way valve means in the form of a ball check valve 86 which is biased against opening 83 by suitable resilient biasing means such as spring 88 which is itself supported by bracket 73 which in turn is biased away from closed end 80 of body member 76 by suitable resilient biasing means such as spring 90. Reciprocal movement of plunger member 78 within bore 77 causes ball check valve 86 to cyclically open and close opening 83 to enable fluid to flow from the fluid resevoir in chamber 82 into pressurization chamber 84 and then close to enable the fluid in chamber 84 to be compressed and move plunger member 78 away from closed end 80 of body member 76 to provide the cyclically pressurized fluid interface within the drive train operatively connecting the valve member to plunger member 78.

Plunger member 78 has a second fluid passageway 85 through a side wall providing fluid communication between first fluid passageway 89 and chamber 82 which, as previously described, may be cyclical according to reciprocal movement of plunger member 78.

The height "$h_1$" denotes the height of the fluid resevoir within chamber 82 heretofore limited by the height of the second fluid passageway 85 into chamber 82. The improved lash adjuster assembly is provided by substantially increasing the height of the resevoir by including an inverted hollow insert member 79 within chamber 82 preferably having a generally cylindrical configuration having a generally closed end disposed above the entrance location of second fluid passageway 85 into chamber 82 facing away from closed end 80 of body member 76 save for at least one fluid entrance opening 81 therethrough communicating between bore 77 and chamber 82 and an opposite open end thereof facing towards closed end 80 of body member 76 with the outer surface of the periphery of insert member 79 adjacent the open end secured in fluid tight sealing engagement with the inner surface of the wall of plunger member 78 surrounding chamber 82 below the location at which second fluid passageway 85 enters chamber 82. Since chamber 82 is essentially closed at both ends excepting for vent 71 and opening 83 previously described, plunger member 78 is divided into a copper portion 59 and a lower portion 37 suitably secured together and which able to be separated from each other during assembly of adjuster assembly 200 to enable insert member 79 to be inserted into chamber 82 of plunger member 78. The side wall of insert member 79 is spaced-apart from the inner surface of bore 77 sufficiently to provide a third fluid passageway 87 providing fluid communication between entrance opening 81 of insert member 79 and second fluid passageway 85 to enable fluid to flow from the fluid source through first fluid passageway 89 and thence through second fluid passageway 85 and thence through opening 81 into the fluid resevoir in chamber 82.

As in the case of assembly 150, insert member 79 enables the height of the fluid resevoir to rise from "$h_1$" to "$h_2$" as shown in FIG. 4 which substantially increases the capacity thereof to provide improved performance of assembly 200 particularly after an extended period of engine shut-down.

Figure 5:
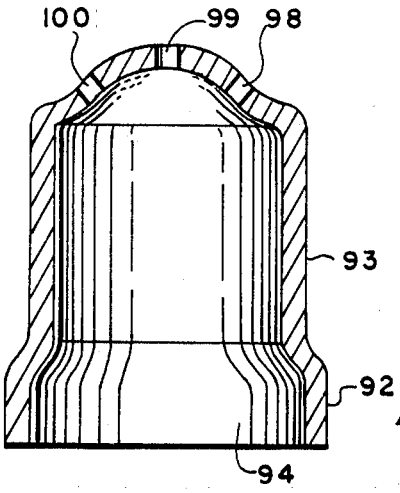
FIG. 5 shows a central side elevation cross-sectional view of an embodiment of an insert member used to provide the improved lash adjuster assembly of the invention.

FIG. 5 shows central cross-section through an embodiment of a hollow inverted insert member adapted to increase the fluid resevoir capacity of improved lash adjuster assemblies of the type described herein.

As viewed in FIG. 5, the insert member is provided with a generally closed upper end 96 and a generally opposite open end 94. The wall of the insert member adjacent open end 94 is flared radially outwardly to enable the insert to be secured in fluid tight sealing engagement to the wall of the plunger member chamber surrounding the fluid resevoir below the entrance location of the fluid passageway through the wall of the plunger member into the chamber containing the fluid resevoir. The remaining wall of the insert member is recessed radially inwardly, such as referenced at 93, to provide the third fluid passageway previously described. The upper closed end of the insert member is provided with three fluid entrance openings (98, 99, 100) therethrough of which entrance openings 98 and 100 are respectively disposed through spaced-apart undulated sections of the insert member closed end to insure a fluid entrance way into the fluid resevoir in cases where an opening such as opening 99 presses tightly against the vent opening in the generally closed end of the plunger member.

What is claimed is:

1. An improved fluid operated lash adjuster assembly for preventing back lash in of an internal combustion engine valve member drive train, said assembly including a body member mounted on the engine, said body member having a bore therein having an open end and a closed end surrounded by a wall thereof having a first fluid passageway therethrough communicating between the body member bore and a source of fluid, a plunger member moveably disposed within said body member bore and having a fluid resevoir therewithin whose capacity is defined by the height of a second fluid passageway through a side wall thereof surrounding said chamber for receiving fluid from the first passageway, said assembly having a fluid pressurization chamber between said resevoir and said body member closed end and including one-way valve means beetween said resevoir and said pressurization chamber operable to cyclically pressurize fluid from the resevoir in response to reciprocating movment of the plunger member in response to rotation of a rotary cam member driven by the engine, wherein the improvement is characterized by said plunger member including an inverted hollow insert member disposed within said plunger member chamber, said insert member having an open-end thereof facing toward the closed end of the body member bore surrounded by a periphery of the insert member that is secured in fluid tight sealing engagement with the wall of the plunger member surrounding the chamber below the location of said second fluid passageway, said insert member having a generally closed upper-end above said second fluid passageway having at least one fluid entrance opening therethrough providing fluid communication between said plunger member chamber and said resevoir, and said insert member having a side wall thereof displaced from the plunger member wall surrounding the chamber sufficiently to provide a third fluid communicating passageway between the second fluid passageway and said insert opening enabling fluid to flow from the second passageway through the insert opening and into the resevoir enabling the resevoir to rise within said insert member above the location of the second fluid passageway thereby enlargening capacity of the resevoir and enhancing operation of the assembly.

2. The assembly of claim 1 wherein the body member is disposed in a bore in the engine and the cam member operatively engages the plunger member.

3. The assembly of claim 1 wherein the body member is mounted for reciprocal movement within a bore of the engine and the cam member operatively engages the closed end of the body member causes said body member to move reciprocally within the bore.

4. The assembly of claim 4 wherein the one-way valve means comprises a ball check valve biased in fluid sealing engagement against an opening between the resevoir and the pressurizing chamber.

5. The assembly of claim 1 wherein the one-way valve means comprises a substantially flat member biased in fluid sealing engagement against an opening between the resevoir and the pressurizing chamber.

6. The assembly of claim 1 including retainer means secured to the body member bore and operative to hold the plunger member to the body member while limiting movement thereof away from the closed end of the body member bore to within a prescribed distance.

7. The assembly of claim 1 including means for biasing the plunger member away from the closed end of the body member.

8. The assembly of claim 3 wherein the body member closed end includes roller means operable to engage the cam member and cause the reciprocal movement of the body member in response to rotation of the cam member.

* * * * *